US008925114B2

(12) United States Patent
Jackson et al.

(10) Patent No.: US 8,925,114 B2
(45) Date of Patent: Jan. 6, 2015

(54) PERSPIRATION CONCEALING BRASSIERE

(71) Applicants: Jessica Rose Jackson, Hoboken, NJ (US); Nicholas Peter Mamola, Wyckoff, NJ (US)

(72) Inventors: Jessica Rose Jackson, Hoboken, NJ (US); Nicholas Peter Mamola, Wyckoff, NJ (US)

( * ) Notice: Subject to any disclaimer, the term of this patent is extended or adjusted under 35 U.S.C. 154(b) by 79 days.

(21) Appl. No.: 13/761,528

(22) Filed: Feb. 7, 2013

(65) Prior Publication Data

US 2013/0303049 A1 Nov. 14, 2013

Related U.S. Application Data

(60) Provisional application No. 61/644,777, filed on May 9, 2012.

(51) Int. Cl.
*A41C 3/08* (2006.01)
*A41C 3/00* (2006.01)

(52) U.S. Cl.
CPC ..... *A41C 3/08* (2013.01)
USPC ..... 2/54; 2/53; 450/37

(58) Field of Classification Search
USPC ..... 2/105, 106, 113–115, 69, 55–58, 53, 2/54, 109, 78.1; 450/37
See application file for complete search history.

(56) References Cited

U.S. PATENT DOCUMENTS

| | | | | |
|---|---|---|---|---|
| 1,477,218 | A * | 12/1923 | Guinzburg | 2/105 |
| 3,421,514 | A * | 1/1969 | Friedlander | 450/30 |
| 3,474,465 | A * | 10/1969 | Artzt | 2/113 |
| 3,588,916 | A * | 6/1971 | Glatt | 2/53 |
| 5,042,089 | A * | 8/1991 | Carmer | 2/55 |
| 6,145,129 | A * | 11/2000 | Czekalla et al. | 2/53 |
| 6,183,339 | B1 * | 2/2001 | Thompson | 450/1 |
| 6,347,407 | B1 * | 2/2002 | Dowell | 2/113 |
| 6,591,425 | B1 * | 7/2003 | Zellers | 2/54 |
| 7,066,784 | B2 | 6/2006 | Peay | |
| 7,429,206 | B2 * | 9/2008 | Perry | 450/86 |
| D630,817 | S | 1/2011 | McKee | |
| D641,954 | S | 7/2011 | Glass | |
| 8,109,806 | B2 | 2/2012 | Bodnar | |
| 2002/0022433 | A1 | 2/2002 | Yeung et al. | |
| 2004/0098783 | A1 | 5/2004 | Parson et al. | |
| 2008/0052802 | A1 * | 3/2008 | Bryan | 2/54 |
| 2008/0086791 | A1 * | 4/2008 | Kirkwood Samuel et al. | 2/54 |
| 2010/0005560 | A1 * | 1/2010 | Albizre | 2/54 |

* cited by examiner

*Primary Examiner* — Gloria Hale
(74) *Attorney, Agent, or Firm* — Scott D. Smiley; Mark C. Johnson; The Concept Law Group, P.A.

(57) ABSTRACT

A perspiration concealing brassiere having a brassiere-shaped body with a left side and a right side, and a left sleeve and a right sleeve both coupled to the brassiere-shaped body, the left and right sleeves each defining an arm placement zone, extending outwardly away from at least one of the left and right sides of the brassiere-shaped body, and having a fluid inhibiting layup spanning an inferior portion of the sleeve, the fluid inhibiting layup including an outer layer, a mid-layer located between the outer layer and an inner layer and being of a material that is operable to absorb and retain fluid, the inner layer being located beyond the mid-layer and being of a material different from the mid-layer.

20 Claims, 5 Drawing Sheets

100

A-A

100

100

PERSPIRATION CONCEALING BRASSIERE

CROSS-REFERENCE TO RELATED APPLICATION

This application claims priority to U.S. Provisional Patent Application No. 61/644,777 filed on May 9, 2012, the entirety of which is incorporated by reference.

FIELD OF THE INVENTION

The present invention relates generally to upper body undergarments and, more particularly, relates to brassieres with the ability to capture and conceal a user's underarm perspiration.

BACKGROUND OF THE INVENTION

It is well known that most women wear brassieres (also commonly known as "bras") on most occasions and for most activities to provide support for their breasts. Most brassieres are designed to be placed directly over the skin of a user, at which point the user then overlays one or more other garments that form the outer exterior seen by the viewing public. In many instances throughout a given day, human beings generate underarm perspiration due to internal and external influences felt on the body. Underarm perspiration is, for the most part, an uncontrollable bodily reaction that many users of brassieres find problematic to control and conceal from the viewing public. These problems are still very much prevalent even when considering the advent of underarm deodorant and medical procedures, such as Botox.

Most known brassiere constructions fail to provide adequate protection from underarm perspiration as there is no bra material under the axillary portion of the user's arm. This causes any generated perspiration to accumulate and/or transfer to the next garment on top of the brassiere or to the brassiere itself. As such, an outer garment will absorb this perspiration, thereby producing a visual indication of the perspiration. This visual indication often causes embarrassment, creates a negative stigma associated with the user, and is physically uncomfortable for the user, in addition to other issues. The accumulation of perspiration also causes detrimental effects for the user's clothing as it known to cause unpleasant odors, coagulate and solidify in users' clothing when present with any deodorant being worn by the user, and to cause stains that are difficult to remove from many articles of clothing, among other negative effects.

As wearing a brassiere is often a necessary article of clothing for most women, wearing multiple layers of clothing to conceal any perspiration is problematic. Wearing a brassiere is often uncomfortable enough for many users, but when supplemented with multiple layers of clothing that often exert additional pressure on the user, any discomfort is magnified. Additionally, many hot environmental climates prevent or make it very uncomfortable for a user to layer more than just the brassiere and an outer garment. Layering multiple clothes also produces a bulky appearance which many users find undesirable. Moreover, layering clothing also prevents a user from partaking in many activities as it makes it difficult for the user to move in addition to being uncomfortable for the user.

In an attempt to provide an adequate remedy to the above-described issues and/or concerns, some known undergarments include perspiration inhibiting characteristics. Most of these known undergarments, however, do not provide the supporting characteristics that women require from brassieres nor could they be adapted to provide the same. Furthermore, many of those undergarments do not have the ability to produce the required support of a brassiere, in addition to providing comfort to the user, as the entire undergarment is made from a material that is uncomfortable to the user, i.e., a rough or abrasive material. Furthermore, many of those undergarments are made entirely from a form-fitting material, which many users find undesirable.

Some known undergarments have attached sleeves to a standard brassiere, but those portions of the sleeve or brassiere opposite to a user's axilla do not have the protection required to inhibit the transfer of perspiration and simultaneously provide a comfortable surface that contacts the user. Other known undergarments do not have the construction or layup of materials adjacent to the sweat zone that adequately provides comfort to the user while simultaneously, and effectively, inhibiting the transfer of fluid, e.g., sweat.

Other known undergarments have pockets or excess pieces of material coupled to the undergarment that captures perspiration generated by the user. These excess pieces of material drape down the sides of the undergarment, which is not aesthetically pleasing to many users. Also, the material produces an uncomfortable feeling to many users as pooling of the perspiration may occur and because the material moves around if the user's arm lifts up or moves around. Many undergarments have upper portions of the sleeves that have open slits or apertures that get bunched with garments placed over the undergarment. In addition those open slits or apertures produce an uncomfortable feeling to a user as they do not emulate the feel of typical T-shirts, e.g. a sleeve that covers the posterior and anterior sides of a user's arm.

Therefore, a need exists to overcome the problems with the prior art as discussed above.

SUMMARY OF THE INVENTION

The invention provides a perspiration concealing brassiere that overcomes the hereinafore-mentioned disadvantages of the heretofore-known devices and methods of this general type and that provides a sleeved brassiere that effectively inhibits perspiration generated from a user. The brassiere is constructed to alleviate many of the issues found in the prior art brassieres or other undergarments by having a three-ply layup opposite to the axillary area. This three-ply layup effectively impedes the transfer of fluid from the user to any outer garment worn by the user. The inventive brassiere accomplishes the above while creating an aesthetically pleasing appearance to the viewing public and providing comfort to the user.

With the foregoing and other objects in view, there is provided, in accordance with the invention, a perspiration concealing brassiere that includes a brassiere-shaped body with a left side and a right side and a left sleeve and a right sleeve both coupled to the brassiere-shaped body. The left and right sleeves each define an arm placement zone, extend outwardly away from at least one of the left and right sides of the brassiere-shaped body, and have a fluid inhibiting layup spanning an inferior portion of at least one of the left and right sleeves. Each fluid inhibiting layup also includes a portion that is substantially adjacent to at least one of the left and right sides of the brassiere-shaped body. The fluid inhibiting layup also includes an outer layer, an inner layer, and a mid-layer located between the outer layer and the inner layer and being of a material that is different from a material of the inner-layer and operable to absorb and retain fluid.

In accordance with a further feature of the present invention, the brassiere-shaped body further includes an open position and a closed position, the brassiere-shaped body placed in the closed position by two fastening members.

In accordance with another feature, an embodiment of the present invention includes the fluid inhibiting layup extends from at least one of the left and right sides of the brassiere-shaped body to the inferior portion of at least one of the left and right sleeves.

In accordance with an additional feature of the present invention, each of the left and right sleeves further has a distal end, a proximal end, and a sleeve length separating the distal and proximal ends, wherein the fluid inhibiting layup extends from at least one of the left and right sides of the brassiere-shaped body to a point along at least one of the left sleeve length and the right sleeve length.

In accordance with yet another feature of the present invention, the fluid inhibiting layup substantially extends an entire length of at least one of the left sleeve length and the right sleeve length.

In accordance with an additional feature, each of the left and right sleeves further includes an upper portion of a material different from the material of the outer layer, mid-layer, and inner layer.

In accordance with a further feature of the present invention, the material of the mid-layer is selected from the group consisting of high-absorbent polymers, copolymers, lint-free and ultrasonically bonded spun-bound fabric, spun-bound polypropylene, cellulose, epoxy-resin coatings, and the like.

In accordance with an additional feature of the present invention, the material of the inner layer is selected from the group consisting of nylon, cotton, spandex, rayon, and the like.

In accordance with the present invention and in combination with a brassiere-like garment having two shoulder strap portions and a left side defining a left opening and a rights side defining a right opening, an improvement includes (1) a left sleeve coupled to the left side of the brassiere-like garment and including a proximal end defining a proximal opening adjacent to the left opening, a distal end defining a distal opening, and a length separating the distal and proximal ends of the left sleeve, the left sleeve defining an arm placement zone and (2) a right sleeve coupled to the right side of the brassiere-like garment and including a proximal end defining a proximal opening adjacent to the right opening, a distal end defining a distal opening, and a length separating the distal and proximal ends of the right sleeve, the right sleeve defining an arm placement zone. The left and right sleeves of the brassiere-like garment each having a fluid inhibiting layup spanning an inferior portion of the left sleeve length and right sleeve length of the left and right sleeves, respectively, the fluid inhibiting layup including an outer layer, an inner layer, and a mid-layer located between the outer layer and the inner layer and being of a material that is different from a material of the inner-layer and is operable to absorb and retain fluid.

In accordance with a further feature of the present invention, the brassiere-like garment has a first end with a fastening member and a second end with a fastening member, each fastening member shaped to be removably couplable with one another.

In accordance with an additional feature of the present invention, the upper portion of each of the left and right sleeves is free of any appreciable apertures located along the left and right sleeve lengths, respectively.

In accordance with the present invention, a perspiration concealing brassiere has also been disclosed that includes a brassiere-shaped garment with a left side adjacent to a left side abdomen area of a user, a right side adjacent to right side abdomen area of the user, and two shoulder straps portions each extending from a front side of the brassiere-shaped garment to a rear side of the brassiere-shaped garment. Additionally, a left sleeve and a right sleeve are both coupled to, and extending outwardly away from, the left and right side of the brassiere-shaped garment, respectively. The left and right sleeves each (1) have a proximal end defining a proximal opening, a distal end defining a distal opening, and a length separating the distal and proximal ends, (2) define an arm placement zone including at least one of a left and a right arm of the user, and (3) have a fluid inhibiting layup spanning an inferior portion of the sleeve and include a portion located adjacent to an axillary area of the at least one of the left and right arm of the user. The fluid inhibiting layup includes a first layer, a second layer being of a material that is operable to absorb and retain fluid, and a third layer being of a material different from the second layer, the second layer located between the first and third layers.

Although the invention is illustrated and described herein as embodied in a perspiration concealing brassiere, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting but rather to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances, these terms may include numbers that are rounded to the nearest significant figure. In this document, the term "longitudinal" should be understood to mean in a direction corresponding to an elongated direction from one sleeve opening to another sleeve opening.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
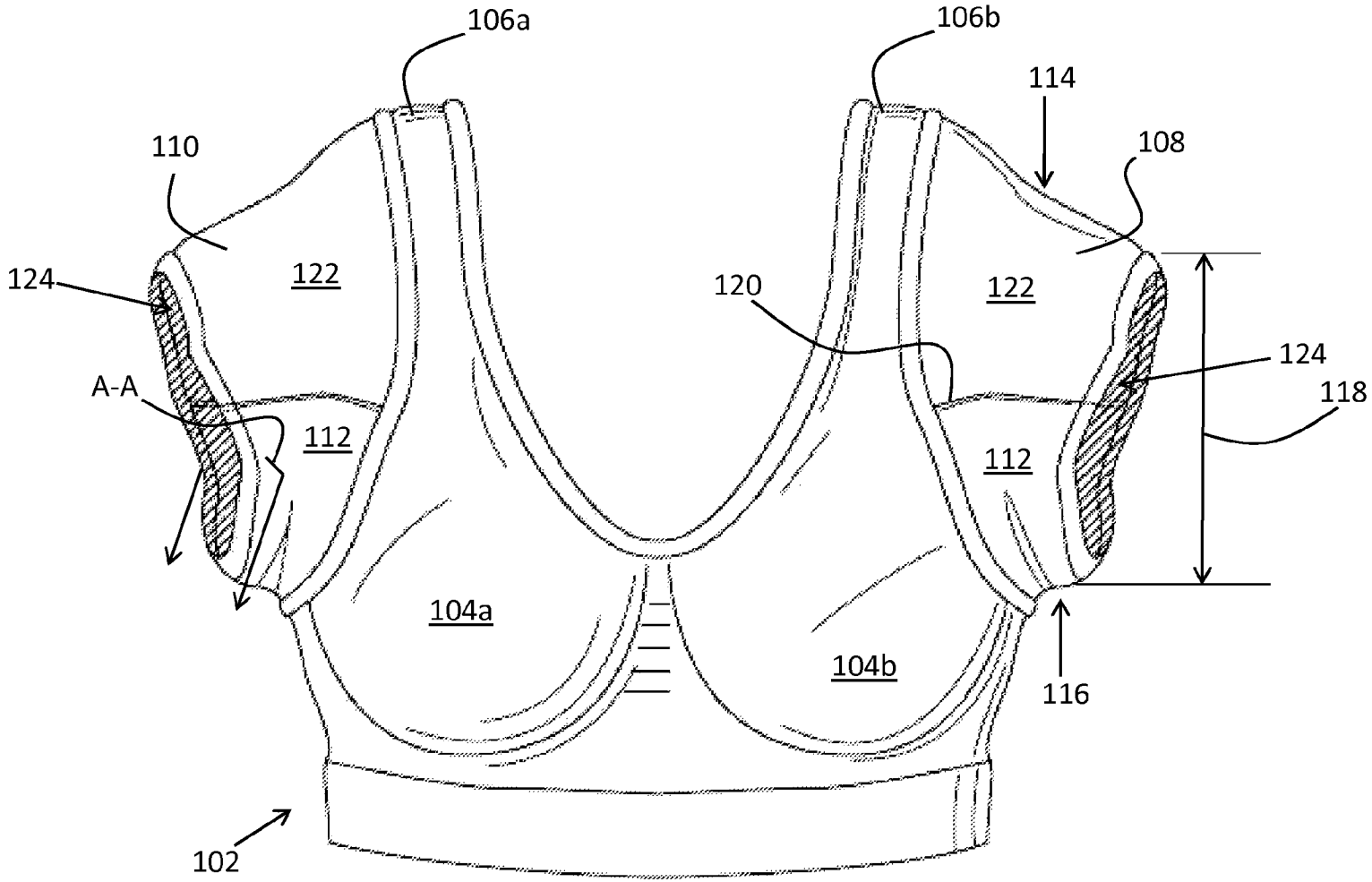
FIG. 1 is a perspective front view of a perspiration concealing brassiere-like garment with two sleeves, each sleeve having a fluid inhibiting layup on an inferior portion of the sleeve in accordance in the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel brassiere-like garment that effectively and efficiently conceals perspiration generated by a user from being seen by the viewing public. Embodiments of the invention also provide a brassiere-like garment that provides comfort to the user while generating the support required by those known brassiere-like garments. The term "brassiere-like" shall refer to any garment that includes a front portion that defines cavities sized to receive and support a woman's breasts. This includes brassieres, T-shirts, jackets, sport clothing, and the like. The term "brassiere" may refer to those known traditional brassieres, sport bras, and the like. Although the present invention is generally utilized by a woman, it shall also not be so limited, as it may be used to in combination with those upper-body support garments used for men or women. Furthermore, the present invention also permits brassiere-like garments to be utilized with sleeves that emulate the comfort generally associated with T-shirts.

Referring now to FIG. 1, one embodiment of the present invention is shown in a perspective front view. FIG. 1 shows several advantageous features of the present invention, but, as will be described below, the invention can be provided in several shapes, sizes, combinations of features and components, and varying numbers and functions of the components. The first example of a perspiration concealing brassiere 100, as shown in FIG. 1, includes a body 102 with two cup portions 104*a-b* on the front side (shown in FIG. 1) of the brassiere and two arm strap portions 106*a-b*. The arm strap portions 106*a-b* extend upwardly from the two cup portions 104*a-b* to the rear side (shown in FIG. 4) of the brassiere. The body 102, which includes the cup and arm strap portions 104*a-b*, 106*a-b* are utilized to support the breasts or chest area of a user. The body 102 may be made from a material generally associated with brassiere-like garments, which may include fabric or polymer-based material that may have elastic or inelastic characteristics. The body 102 may also incorporate or utilize underwire, padding, and/or other support mechanisms.

The brassiere-like garment 100 includes a left sleeve 108 and a right sleeve 110 that advantageously includes a fluid inhibiting layup 112, or a combination of materials placed over one another that reduces or prevents the flow of fluid, e.g., perspiration, to the outer surface of the garment. As a corollary, this also prevents perspiration to an outer garment worn by the user. The sleeves 108, 110 of the garment 100 have a superior, or upper, portion 114 and an inferior, or lower, portion 116. In one embodiment, the inferior portion 116 of the sleeves 108, 110 extends from the base of the sleeve and extends upwardly to the median of the sleeve width (represented on the left sleeve with arrows 118). In other embodiments, the inferior portion 116 may extend just above or below the median of the sleeve width. The fluid inhibiting layup 112 is advantageously placed in a position along the inferior portion 116 of the sleeves 108, 110 to capture and retain perspiration generated by the user. In further embodiments, the inventive fluid inhibiting layup 112 may be placed in other locations on the brassiere-like garment 100 or may be placed on an undergarment without sleeves as disclosed herein. For example, the fluid inhibit layup may be placed underneath or around the cup portions 104*a-b* or in a rear area of the brassiere-like garment 100 to capture and retain any perspiration that is generated.

Figure 2:
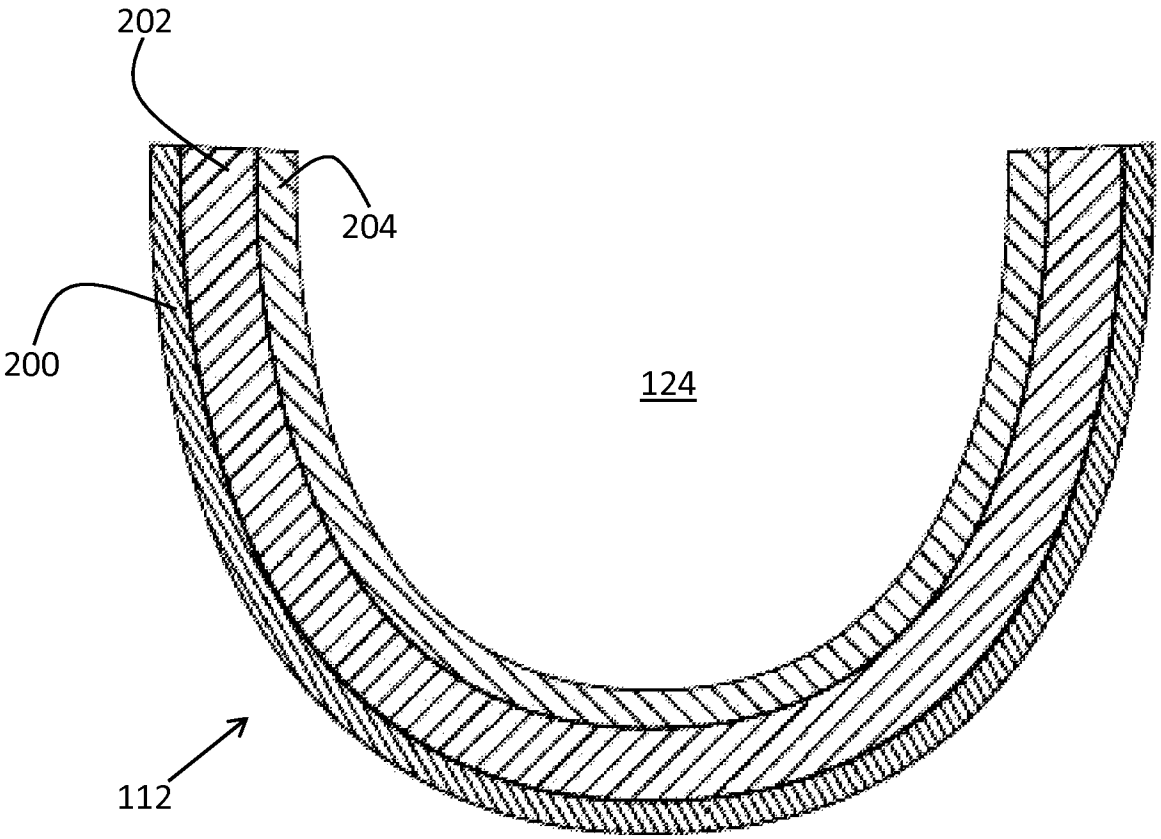
FIG. 2 is a close-up, cross-sectional, view of the fluid inhibiting layup of FIG. 1 in accordance with one embodiment of the present invention.

FIG. 2 illustrates a cross-sectional, close-up, view of a section A-A from FIG. 1. This novel and inventive layup 112 includes at least three layers 200, 202, 204. With reference to both FIGS. 1 and 2, the first layer 200, also referred to herein as an outer layer, generally forms the outer surface of the sleeves 108, 110, or the portion of the sleeves 108, 110 that generally makes contact the outer garment worn by the user. In one embodiment, the first layer 200 consists of essentially the entire outer surface of the sleeves 108, 110. Said another way, the first layer 200 covers the circumferential surface of the sleeves 108, 110. In other embodiments, the first layer 200 may only cover the inferior portions 116 of the sleeves 108, 110 or any portion thereof.

In one embodiment, the first layer 200 may be made from cotton, nylon, spandex, micro-fiber, or other material that will conform itself to a particular shape of the user's arm. The first layer 200 should be generally made with a material that is durable, or made to substantially resist the outside elements (e.g., rain, dirt, etc.) without deteriorating, while having material properties that reduce the coefficient of friction in order not to materially affect or bunch with an outer garment also being worn by the user. As shown in FIG. 1, the layup 112, which include the first layer 200 may extend from the inferior portion 116 of the sleeves 108, 110 to some portion 120 along the sleeve width 118. In one embodiment, the first layer 200 may couple with another material that forms an upper, or superior, portion 122 of the sleeves 108, 110. The first layer 200 couples to the upper portion 122 through one or more seams or stitches. The upper layer 122 includes the superior portion 114 of the sleeves 108, 110 and generally begins and terminates with the end and beginning of the fluid inhibiting portion 112, respectively. Advantageously, the upper portion 122 may be made from a light-weight, and soft, material such as silk, nylon, rayon, or gossamer. The contrast between the upper portion 122, which may extend below or above the line 120 shown in FIG. 1, and the fluid inhibiting layup 112 provides a user with the versatility of having an effective and efficient perspiration concealing garment, while simultaneously providing increased comfort to the user. In further embodiments, the upper portion 122 is without any voids or openings, generally referred to as "apertures," which reduce the probability of the sleeves 108, 110 from getting caught on, or bunching with, any exterior garments placed over the sleeves 108, 110. The upper portion 122 is said to be free of any appreciable apertures located along either of the left and right sleeve lengths if the aperture does not substantially extend the entire length, or within 1-2 inches of the entire length, of the sleeve from which the aperture is defined.

Beyond, or in some instances above, the first layer 200 is the second layer 202, which may also be referred to as a mid-layer. The second layer 202 is made of a material that resists the transfer of fluid, e.g., sweat, to the first layer 200. In one embodiment, the second layer 202 is DryTech® or other similar superabsorbent polymer (SAP) material that is known in the art to absorb and retain fluid. The term "retain" is generally referred to herein as having the ability to inhibit the transfer of a typical amount of perspiration generated from a user from one side of the material to another. In some embodiments, the fluid, i.e., perspiration, is not transferred from one side of a material to another. In other embodiments, the fluid transfers over a reasonable period of time, generally 2-8 hours. The inclusion of this second layer 200 gives the brassiere-like garment 100 its fluid inhibiting characteristics, thereby concealing any signs of perspiration. It also eliminates the need for many users to layer multiple garments to conceal any generated perspiration. In other embodiments, the material of the second layer 202 may be made of other SAP which may be manufactured using any suitable method, e.g., gel, solution, or suspension polymerization. Additionally, the second layer 202 may be made from lint-free spun bound fabric that is ultrasonically bonded, spun-bound polypropylene, cellulose, epoxy-resin coatings, or other known materials.

In further embodiments, the second layer 202 may have its own layup of materials that facilitate the absorption and retention of fluids. For example, the second layer 202 may consist of a primary layer that has a high absorption rate, e.g., spun-bound polypropylene, while having a secondary layer that has a relatively impermeable backing, e.g., closed-cell foam. These above-described materials may be in combination with one another or alone to produce the second layer 202. In one embodiment, the second layer 202 is sewn or stitched into one or more inferior portions 116 of the sleeves 108, 110. In other embodiments, the second layer 202 is sandwiched between the first and third layers 200, 204, such that it would be considered what is known in the art as a "floating" layer. Said another way, the second layer 202 is encapsulated by the first and third layers 200, 204. The material of the second layer 202, however, should also be generally elastic and shape-conforming to the arm and axilla area of the user.

Beneficially, the third layer 204 (also referred to herein as the inner layer) is located beyond, or in some instances above, the second layer 202 and is made of a material that is different than the material of the second layer 202. In one embodiment, the third layer 204 is made of nylon, cotton, spandex, rayon, or other material that is operable to transfers fluid. As many materials used to absorb and retain fluid are uncomfortable to the user's touch, the third layer 204 provides the user with the ability to comfortably wear a brassiere and not worry about showing signs of perspiring. As many of those known fluid absorbing and retaining materials produce adverse reactions to the user, and because many brassiere-like garments 100 are generally worn close the user's skin, the third layer 204 advantageously removes those concerns from the user by distancing the second layer 202 from contacting the user's skin.

The third layer 204 can be seen exposed to an arm placement zone 124 defined by the sleeves 108, 110. In one embodiment, the third layer 204 spans the circumferential area of the sleeves 108, 110. In other embodiments, the third layer 204 terminates at some portion 120 along the sleeve width 118 and may be sewn or stitched in with one or more other portions on the sleeve 108, 110. The unique layup 112 provides a brassiere-like undergarment 100 that resists any underarm perspiration from being shown or exchanged to the outside surface of a user's clothes. Again, the layup 112 may span or be placed at any inferior portion 116 of the sleeves 108, 110 to adequately capture and retain perspiration.

Figure 3:
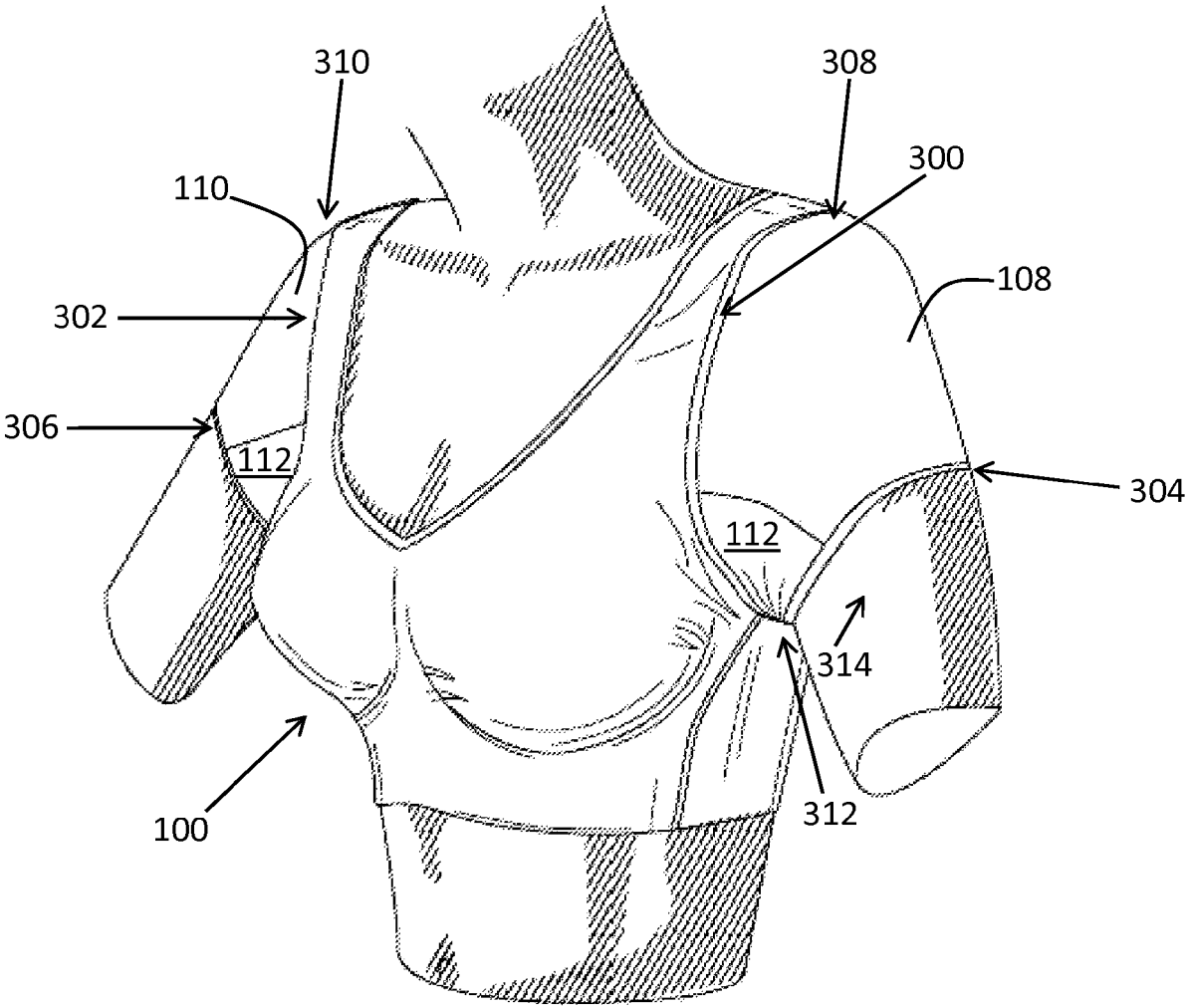
FIG. 3 is a perspective downward-looking view of the brassiere-like garment of FIG. 1 being worn in accordance with the present invention.

With reference now to FIG. 3, the brassiere-like garment 100 can be seen worn on a user in accordance with the present invention. The brassiere-like garment 100 has a left side 300 and a right side 302 generally adjacent to the left and right side of a user's abdomen. The left and right sides 300, 302 of the brassiere-like garment 100 define left and right openings respectively (now shown). The left and right openings generally form the opening where a user inserts their left or right arm, respectively. The left and right sleeves 108, 110 each have distal ends 304, 306, that define distal openings (not shown), and proximal ends 308, 310, that define proximal openings (not shown). The proximal openings of each sleeve 108, 110 are adjacent to the left and right openings of the brassiere-like garment 100 to permit the user's arm to be effectively placed through the brassiere-like garment 100 and into, and through, the sleeves 108, 110.

In one embodiment, the sleeves 108, 110 are coupled to the left and right sides 300, 302 of the brassiere-like garment 100 through one or more seams, made from fabric or other material known in the art to fasten fabric together. In other embodiments, the sleeves 108, 110 are coupled to the left and right sides 300, 302 of the brassiere-like garment 100 through clips, fasteners, adhesives, or other fastening means. Each sleeve 108, 110 has a length separating the proximal ends 308, 310 and distal ends 304, 304. In one embodiment, the length of each sleeve 108, 110 is approximately 6-8 inches. In other embodiments, the length of each sleeve 108, 110 may be approximately 14-20 inches or any other length sufficient to at least cover the axilla portion 312 of the user. At minimum, the fluid inhibiting layup 112 covers the axilla portion 312 of the user.

In the preferred embodiment, the fluid inhibiting layup 112 extends from the side portions 300, 302 of the brassiere-like garment 100 and terminates at the distal ends 304, 306 of the brassiere-like garment 100, while spanning from an anterior (front) portion 314 of a user's arm to a posterior (back) portion (not shown) of a user's arm. In other embodiments, the fluid inhibiting layup 112 may extend from other portions of the brassiere-like garment 100 and terminate at other portions along the lengths of the sleeves 108, 110. As FIG. 3 illustrates, the undergarment 100 has sleeves 108, 110 extending outwardly therefrom that include fluid inhibiting layups 112 which resist perspiration from transferring to, and therefore showing on, the outer surface of the underarm portion of the outer garment worn by the user.

Figure 4:
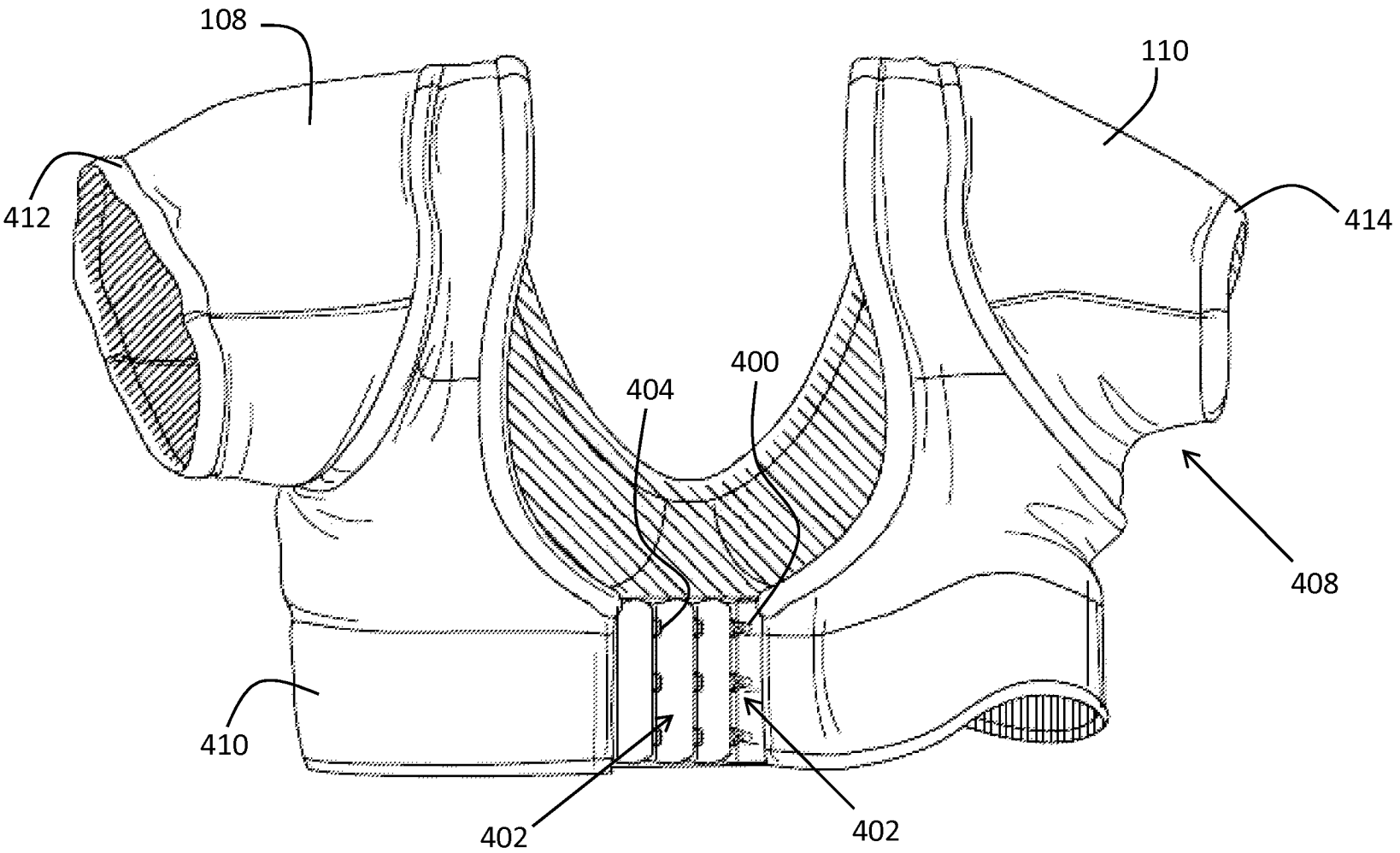
FIG. 4 is a perspective rear view of the brassiere-like garment of FIG. 1 shown in a closed position in accordance with one embodiment of the present invention.
Figure 5:
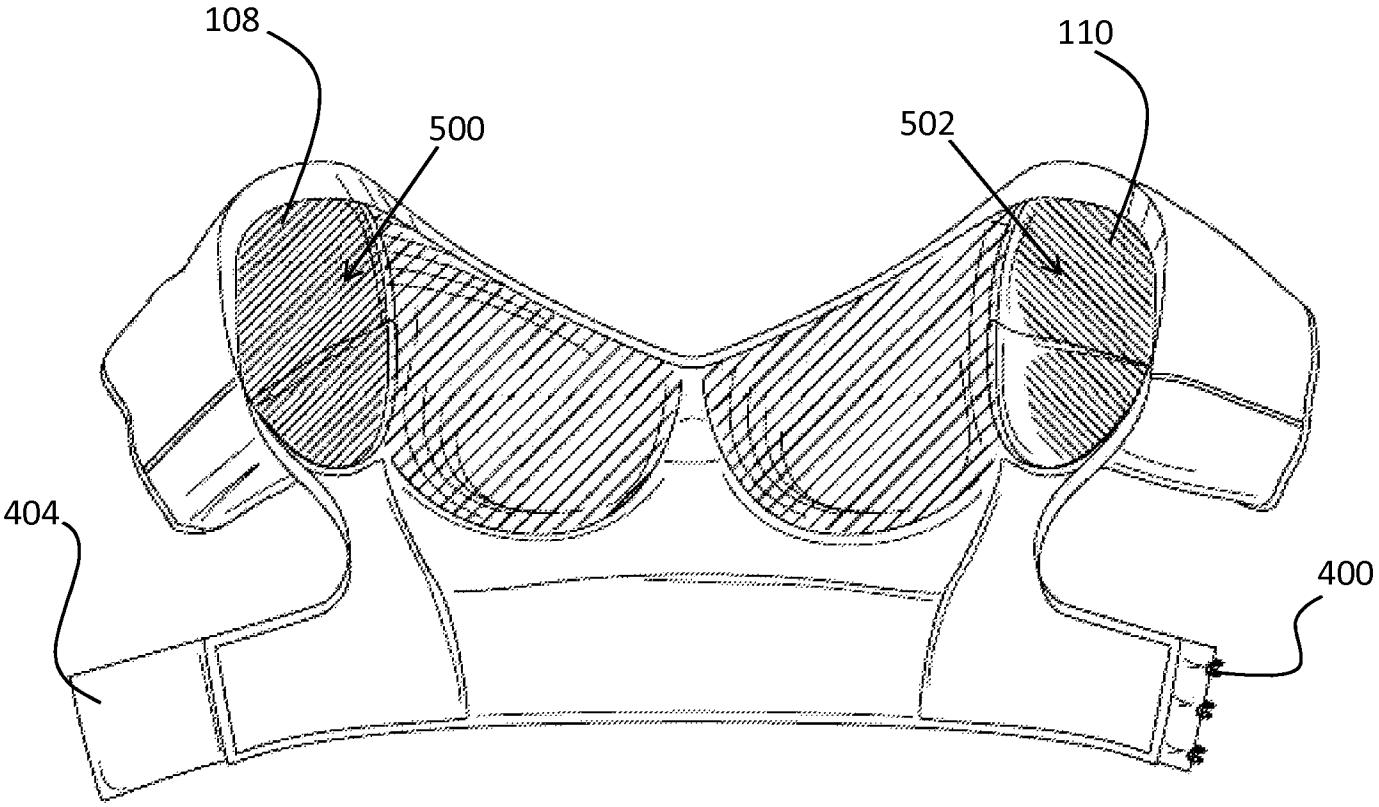
FIG. 5 is a perspective rear view of the brassiere-like garment of FIG. 1 shown in an open position in accordance with one embodiment of the present invention.

With reference to FIG. 4, the brassiere-shaped garment 100 is shown in a closed position such that a fastening member 400 located at a first end 402 of the brassiere-shaped garment 100 is coupled to a fastening member 404 located at a second end 406 of the brassiere-shaped garment 100. The fastening members 400, 404 may be a hook and loop of attachment, alligator clips, buttons, or other known fastening means. FIG. 4 also depicts a posterior, or rear, side 408 of the garment 100, which is adjacent to the posterior side of the user's arm when in use. FIG. 5 illustrates the brassiere-shaped garment 100 in an open position after the fastening members 400, 404 are removed from one another. Also depicted in FIG. 5 are the arm placement zones 500, 502 of both the left and rights sleeves of the brassiere-shaped garment 100.

With reference back to FIG. 4, the brassiere-shaped garment 100 also illustrates a lower portion of the garment 100 having an elastic retention member 410 incorporated therein which provides pressure on the abdomen of the user when worn. Elastic bands, or retention members, 412, 414 may also be employed in the sleeves 108, 110 to prevent bunching and tangling when, and if, an outer garment is placed over the brassiere-shaped garment 100. The elastic retention members 410, 412, 414 also allow the undergarment to expand and retract for a desired fit for users of various sizes.

A perspiration concealing brassiere-like garment has been disclosed that advantageously includes sleeves with a three-ply layup that is placed adjacent to an axillary portion of a user's body and includes a durable outer layer, an absorbent and retaining mid-layer that captures perspiration and prevents transfer of the same to the outer surface of the user's garments, and a soft and fluid transferring inner layer. This unique layup, in combination with a brassiere-like garment, provides an effective support garment for a user while simultaneously and effectively preventing any perspiration from transferring from the brassiere-like garment to the outer garment.

What is claimed is:

1. A perspiration concealing brassiere comprising:

a brassiere-shaped body with a left side and a right side; and a left sleeve and a right sleeve both coupled to the brassiere-shaped body, the left and right sleeves each:

defining an arm placement zone;

extending outwardly away from at least one of the left and right sides of the brassiere-shaped body;

having a fluid inhibiting layup spanning an inferior portion of each of the left and right sleeves and including a portion of the fluid inhibiting layup substantially adjacent to at least one of the left and right sides of the brassiere-shaped body, the fluid inhibiting layup including:

an outer layer;

an inner layer; and a mid-layer located between the outer layer and the inner layer and being of a material that is different from a material of the inner-layer and operable to absorb and retain fluid; and having an upper portion:

extending outwardly away from the at least one of the left and right sides of the brassiere-shaped body toward a distal end of at least one of the left and right sleeves;

disposed on a superior portion of each of the left and right sleeves and coupled to a portion of the fluid inhibiting layup; and of a material different than a material of the mid-layer and the outer layer of the fluid inhibiting layup.

2. The perspiration concealing brassiere according to claim 1, wherein the brassiere-shaped body further comprises:

an open position and a closed position, the brassiere-shaped body placed in the closed position by two fastening members.

3. The perspiration concealing brassiere according to claim 1, wherein:

the fluid inhibiting layup substantially extends an entire length of at least one of the left sleeve length and the right sleeve length.

4. The perspiration concealing brassiere according to claim 1, wherein:

the upper portion is of a material different from the material of the outer layer, mid-layer, and inner layer.

5. The perspiration concealing brassiere according to claim 1, wherein the material of the mid-layer is selected from the group consisting of:

high-absorbent polymers, copolymers, lint-free and ultrasonically bonded spun-bound fabric, spun-bound polypropylene, cellulose, and epoxy-resin coatings.

6. The perspiration concealing brassiere according to claim 1, wherein the material of the inner layer is selected from the group consisting of:

nylon, cotton, spandex, and rayon.

7. In combination with a brassiere-like garment having two shoulder strap portions and a left side defining a left opening and a right side defining a right opening, an improvement comprising:

a left sleeve coupled to the left side of the brassiere-like garment and including a proximal end defining a proximal opening adjacent to the left opening, a distal end defining a distal opening, an upper, superior, portion extending outwardly away from the proximal end of the left sleeve toward the distal end of the left sleeve, and a length separating the distal and proximal ends of the left sleeve, the left sleeve defining an arm placement zone; and a right sleeve coupled to the right side of the brassiere-like garment and including a proximal end defining a proximal opening adjacent to the right opening, a distal end defining a distal opening, an upper, superior, portion extending outwardly away from the proximal end of the right sleeve toward the distal end of the right sleeve, and a length separating the distal and proximal ends of the right sleeve, the right sleeve defining an arm placement zone, said left and right sleeves each having a fluid inhibiting layup spanning an inferior portion of the left sleeve length and right sleeve length of the left and right sleeves, respectively, the fluid inhibiting layup including:

an outer layer;

an inner layer; and a mid-layer located between the outer layer and the inner layer and being of a material that is different from a material of the inner-layer and operable to absorb and retain fluid, the upper portion of the left and right sleeves of a material different than the material of the mid-layer and a material of the outer layer.

8. The improvement according to claim 7, wherein the brassiere-like garment comprises:

a first end with a fastening member and a second end with a fastening member, each fastening member shaped to be removably couplable with one another.

9. The improvement according to claim 7, wherein:

the fluid inhibiting layup of each of the left and rights sleeves extends from the left and right sides of the brassiere-shaped garment, respectively.

10. The improvement according to claim 7, wherein:

the fluid inhibiting layup of each of the left and right sleeves substantially extends an entire length of the left sleeve length and the right sleeve length, respectively.

11. The improvement according to claim 7, wherein:

the upper portion is of a material different from the material of the outer layer, mid-layer, and inner layer.

12. The improvement according to claim 11, wherein:

the upper portion of each of the left and right sleeves is free of any appreciable apertures located along the left and right sleeve lengths, respectively.

13. The improvement according to claim 7, wherein the material of the mid-layer is selected from the group consisting of:

high-absorbent polymers, copolymers, lint-free and ultrasonically bonded spun-bound fabric, spun-bound polypropylene, cellulose, and epoxy-resin coatings.

14. The improvement according to claim 7, wherein the material of the inner layer is selected from the group consisting of:

nylon, cotton, spandex, and rayon.

15. A perspiration concealing brassiere comprising:

a brassiere-shaped garment with a left side adjacent to a left side abdomen area of a user, a right side adjacent to right side abdomen area of the user, and two shoulder straps portions each extending from a front side of the brassiere-shaped garment to a rear side of the brassiere-shaped garment; and a left sleeve and a right sleeve both coupled to, and extending outwardly away from, the left and right side of the brassiere-shaped garment, respectively, the left and right sleeves each:

having a proximal end defining a proximal opening, a distal end defining a distal opening, and a length separating the distal and proximal ends;

defining an arm placement zone including at least one of a left and a right arm of the user;

having a fluid inhibiting layup spanning an inferior portion of the sleeve and located adjacent to an axillary area of the at least one of the left and right arm of the user, the fluid inhibiting layup including a first layer, a second layer being of a material that is operable to absorb and retain fluid, and a third layer being of a material different from the second layer, the second layer located between the first and third layers; and having an upper portion spanning a superior portion of the sleeve and extending outwardly away from at least one of the two shoulder straps portions of the brassiere-shaped garment toward the distal end of at least one of the left and right sleeves, the upper portion of a material different than the material of the second layer and the third layer of the fluid inhibiting layup.

16. The perspiration concealing brassiere according to claim 15, wherein:

the fluid inhibiting layup extends from at least one of the left and right sides of the brassiere-shaped garment.

17. The perspiration concealing brassiere according to claim 15, wherein:

the fluid inhibiting layup substantially extends the entire length of at least one of the left sleeve and the right sleeve.

18. The perspiration concealing brassiere according to claim 15, wherein the material of the second layer is selected from the group consisting of:

high-absorbent polymers, copolymers, lint-free and ultrasonically bonded spun-bound fabric, spun-bound polypropylene, cellulose, and epoxy-resin coatings.

19. The perspiration concealing brassiere according to claim 1, wherein the material of the upper portion of the left and right sleeve is selected from a group consisting of:

nylon, rayon, and gossamer.

20. The improvement according to claim 7, wherein the material of the upper portion of the left and right sleeve is selected from a group consisting of:

nylon, rayon, and gossamer.

* * * * *